US012075858B1

(12) United States Patent
Evans et al.

(10) Patent No.: US 12,075,858 B1
(45) Date of Patent: Sep. 3, 2024

(54) BURP DEVICE WITH RESERVOIR

(71) Applicants: Wilfred Sterling Evans, Charleston, SC (US); Konstantin Dolgan, Shreveport, LA (US)

(72) Inventors: Wilfred Sterling Evans, Charleston, SC (US); Konstantin Dolgan, Shreveport, LA (US)

(73) Assignee: Wilfred Sterling Evans, Charleston, SC (US)

( * ) Notice: Subject to any disclaimer, the term of this patent is extended or adjusted under 35 U.S.C. 154(b) by 39 days.

(21) Appl. No.: 18/107,235

(22) Filed: Feb. 8, 2023

Related U.S. Application Data

(60) Provisional application No. 63/307,677, filed on Feb. 8, 2022.

(51) Int. Cl.
*A41B 13/10* (2006.01)
*A41D 1/215* (2018.01)
*A41D 27/12* (2006.01)

(52) U.S. Cl.
CPC ..... *A41D 1/215* (2018.01); *A41D 27/12* (2013.01)

(58) Field of Classification Search
CPC ..... A41B 13/10; A41B 13/103; A41B 13/106
See application file for complete search history.

(56) References Cited

U.S. PATENT DOCUMENTS 1,797,208 A * 3/1931 Weisz ..... A41D 13/04 24/9
2,640,197 A * 6/1953 Murray ..... A41D 1/215 2/48
4,660,226 A * 4/1987 Quilling ..... A41B 13/103 2/49.4
4,860,381 A * 8/1989 Bartley ..... A41B 13/103 2/49.3
7,526,815 B1 * 5/2009 Kelly ..... A41B 13/10 2/49.1
11,641,887 B2 * 5/2023 D'Amato-Friedman ..... A41B 13/103 2/49.2
2010/0122390 A1 * 5/2010 Sender ..... A41B 13/08 2/49.2
2014/0059733 A1 * 3/2014 Kassis ..... A41B 13/103 2/49.2
2016/0066629 A1 * 3/2016 Marcum ..... A41D 13/04 2/46

* cited by examiner

*Primary Examiner* — Tajash D Patel

(74) *Attorney, Agent, or Firm* — Haynsworth Sinkler Boyd, P.A.

(57) ABSTRACT

A burp device configured to prevent spit up from a baby from contacting a user of the burp device burping the baby includes a front portion configured to be placed on the chest of a user and a neck portion connected to the front portion, the neck portion including a first recess configured to be placed around a portion of the neck of the user. The burp device further includes a back portion connected to the neck portion and configured to be placed on the back of the user, the back portion including a reservoir connected to the back portion opposite the neck portion, the reservoir providing a volume for spit up collection. The back portion further including a pair of channels connected to opposing edges of the back portion and the reservoir, the channels configured to direct spit up into the reservoir and to limit or prevent the reservoir from closing.

9 Claims, 2 Drawing Sheets

BURP DEVICE WITH RESERVOIR

RELATED APPLICATIONS

This application claims priority to U.S. Provisional Patent Application No. 63/307,677 filed on Feb. 8, 2022, the entire disclosure of which is hereby incorporated by reference.

BACKGROUND

Babies frequently spit up, drool or otherwise expel liquids and particulates (collectively, spit up) from their mouths, especially after feeding. To catch the spit up, many parents place a burp cloth over the shoulder and under the baby when burping the baby. While burp cloths do retain some of the spit up, the burp cloths are easily saturated and do not contain large spit ups that are expelled from the baby or spit ups that project out from the baby, which allows the spit up to soil the clothing of the individual burping the baby. This is especially true when the spit up runs down the back of the individual burping the baby. What is needed is a burp device that better captures these spit ups without becoming saturated.

SUMMARY OF THE INVENTION

A burp device configured to prevent spit up from a baby from contacting a user of the burp device burping the baby includes a front portion configured to be placed on the chest of a user and a neck portion connected to the front portion, the neck portion including a first recess configured to be placed around a portion of the neck of the user. The burp device further includes a back portion connected to the neck portion and configured to be placed on the back of the user, the back portion including a reservoir connected to the back portion opposite the neck portion, the reservoir providing a volume for spit up collection. The back portion further including a pair of channels connected to opposing edges of the back portion and the reservoir and rising from the edges of the back portion, the channels connected to edges of the reservoir and configured to direct spit up into the reservoir and to limit or prevent the reservoir from closing. The burp device may further include a pad configured to provide a comfortable surface for the baby. The pad may be removable from the front portion. The pad may include straps, and the front portion may include strap penetrations, the straps being placed through the strap penetrations to connect the pad to the front portion. The front portion may further include weights configured to prevent the burp device from sliding down the back of the user. The neck portion may further include a second recess opposite the first recess. The back portion may further include guides extending from a base surface of the back portion, the guides being configured to direct spit up into the reservoir. The front portion, neck portion and back portion may be formed from silicone or rubber. The straps may include hook and loop fasteners.

DETAILED DESCRIPTION

Figure 1:
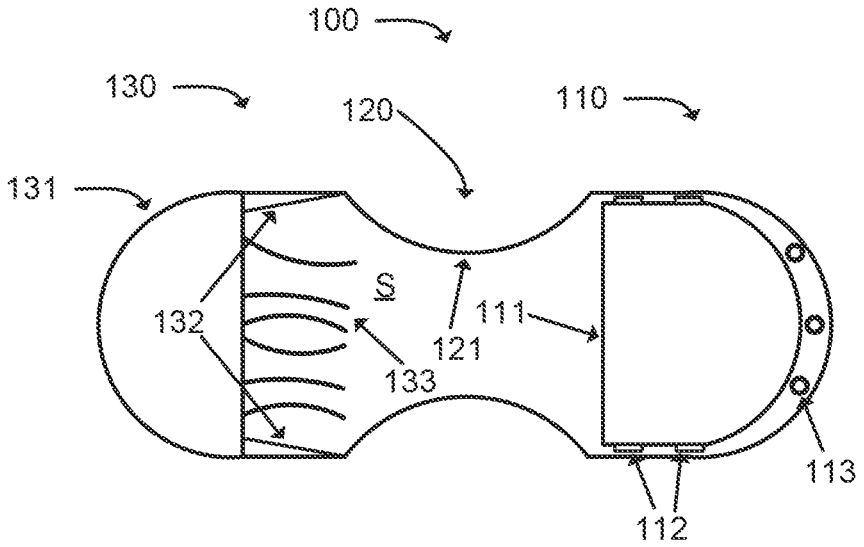
FIG. 1 depicts a front elevation view of an example burp device in which the technology described herein may be implemented.
Figure 2:
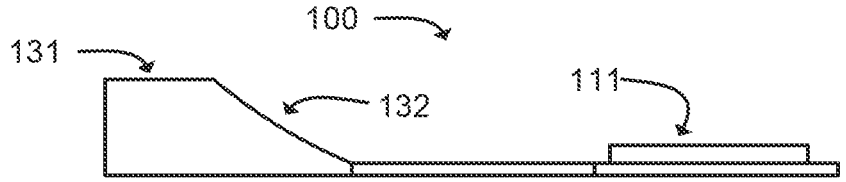
FIG. 2 depicts a right side elevation view of the burp device of FIG. 1.
Figure 3:
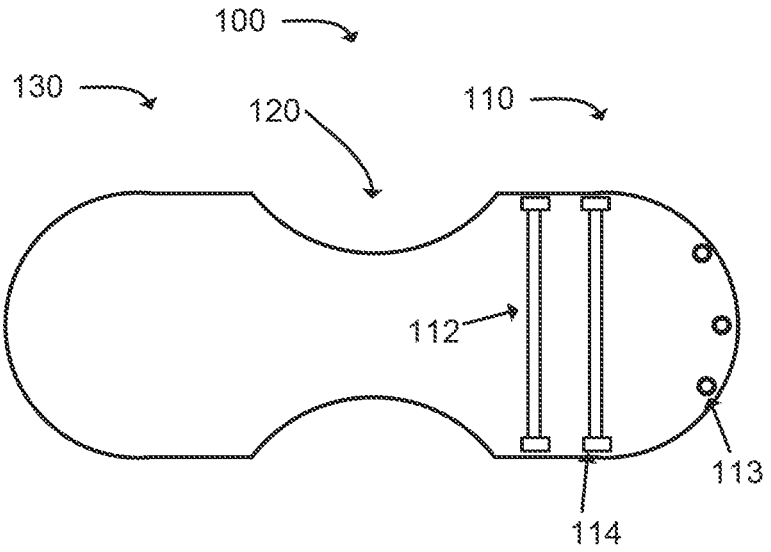
FIG. 3 depicts a back elevation view of the burp device of FIG. 1.

The systems, methods, technologies and/or techniques (hereinafter, the "technology"), described herein, may provide for a burp device that a front portion, a neck portion and a back portion. When the burp device is worn by a user, such as when the user wants to burp a baby, the front portion may be configured to reside on the chest of a user, and the back portion may be configured to reside on the back of a user. The back portion may include a reservoir, which may capture spit up expelled from a baby when a baby is burped and when the user applies the burp devices as described herein. The technology is described in reference to FIGS. 1-3, which reflect example embodiments of the technology. The embodiments depicted in FIGS. 1-3 are examples only, and the present technology may be embodied in many different embodiments in many different ways to produce a burp device having similar and/or different features, styles, appearances and/or uses. FIGS. 1-3 are attached hereto and incorporated by reference.

The technology described herein may provide that the burp device includes a front portion that may be connected to a back portion by a neck portion. The neck portion may reside proximate the neck of the user when the burp device is worn by a user. The neck portion may include one or more recesses, which may correspond to concave areas proximate which the neck is disposed when the burp device is worn by a user. The two recesses of the neck portion may permit the burp device to be worn on the left shoulder or the right shoulder of a user.

The front portion may include a pad, which may be formed as a part of the burp device and/or may be a removable pad, which may be secured to the burp device using fasteners, such as Velcro, snaps, zippers, etc. When the pad is removable, the pad may be washed, such as in a washing machine, separate from the other components of the burp device. The pad may provide a comfortable surface on which a baby may rest when the burp device is used in connection with burping a baby. The pad may also, or alternatively, absorb any spit up that is directed to the front portion of the burp device, which may happen when a baby spits up. This may provide additional protection for a user to limit and/or prevent spit up from contacting the user.

The back portion may include a reservoir that may capture the spit up expelled from a baby. The reservoir may be located at an end of the back portion opposite the neck portion of the burp device. The reservoir may be sized to both hold a suitable amount of spit up from a baby and/or to extend sufficiently away from the back of the user to capture any spit up projected from the baby that would soil the clothing of the user or any surface located near the user. Channels of the back portion may extend from the edge of the burp device and may direct any spit up that may slide down the back portion into the reservoir and may also, or alternatively, maintain the reservoir in an open position when in use. The back portion may also include guides that provide texture to back portion and that direct spit up into the reservoir.

The burp device may be formed from a material or materials that may be easy to clean and that may be comfortable when worn and that may be water, stain and/or spill resistant to limit and/or prevent a user from becoming soiled with spit up, such as when spit up soaks through a traditional burp device. The material or materials may also, or alternatively, be easily cleaned, such as by rinsing off, wiping off, etc. For example, burp device (potentially other than pad) may be formed from silicone, rubber, plastics, waxed cotton, etc. These materials may also provide that the burp device is resilient, returnably resilient and/or flexibly resilient so that the burp device maintains its shape. For example, the resilient material may maintain the reservoir in an open position, or return it to an open position, to make sure that the burp device catches any spit up that is expelled from a baby. As further example, the burp device formed from these materials may be folded, rolled up, etc., such as for storage, and when unfolded, unrolled, etc. may return to its shape, including having the reservoir in an open position. When pad is not formed from the same material as the remaining components of burp device, pad may be formed from, for example, a cushion that is covered by a cloth material (i.e. cotton, synthetics, a cotton and synthetic blend, etc.). This may provide comfort for a baby and/or absorb any spit up that is directed to the front portion.

Burp device may be used when the user places the front portion on his or her chest, the neck portion near the user's neck, such as when a recess is proximate the neck, and the back portion placed on the user's back. The user may then place a baby on or near the pad. The user may burp the baby, which may cause the baby's head, and any spit up expelled from the baby's mouth, to be directed over the shoulder and/or down the back of the user. The spit up may be collected in the reservoir of the back portion, which may prevent the spit up from soiling the user and/or areas around the user. The reservoir, and other components of burp device, may be formed from a resilient and/or returnably resilient material so that when pressure is applied to the reservoir, the reservoir resists deforming and/or returns to an undeformed open shape, which permits the reservoir to hold the spit up.

FIGS. 1 and 2 depict an example embodiment of a burp device 100 in which the technology described herein may be implemented. FIG. 1 depicts a front elevation view of the burp device 100 and FIG. 2 depicts a right side elevation view thereof. Burb device 100 may be configured to capture the spit up from a baby. The burp device 100 may be placed over the shoulder of a user to provide a reservoir 131 proximate the back of the user, which may capture the spit up when the baby is burped. As shown in FIGS. 1 and 2, the burp device 100 may include a front portion 110, a neck portion 120 and a back portion 130.

The front portion 110 may be configured to reside over the chest (a side of the chest, the entire chest, etc.) of the parent when the burp device 100 is used. A portion of a baby (the chest, legs, etc.) may rest against front portion 110 when a baby is burped. The front portion 110 may include a pad 111, which may correspond to a cloth, sponge, padding, silicone or other soft material on which the baby may be placed when burped for comfort for the baby. Additionally, or alternatively, pad 111 may be formed from the same material as the remaining components of burp device 100, such as when pad is formed as a part of burp device. When pad 111 is removably connected to burp device 100, pad 111 may be held in place with, for instance, straps 112, straps, zippers, clips or other known means. In the embodiment depicted herein, straps 112 include book and loop fasteners (i.e. Velcro @, etc.) and pass through strap penetrations 114, which correspond to holes or penetrations in the front portion 110, to connect pad 111 to burp device 100. As better shown in FIG. 3, straps 112 may pass through strap penetrations 114 to connect pad 111 to front portion 110 by connecting the straps 112 to each other on the side of front portion 110 opposite the pad 111. Weights 113 may be included in the front portion to increase the weight of the front portion 110 relative to the back portion 130, which may prevent the burp device 100 from sliding down the back (i.e. because the back portion 130 is heavier than the front portion 110, such as due to the weight of reservoir 130, spit up, etc.). Additionally, or alternatively, the front portion 110 may be formed from a thicker material than the back portion 130 so that the burp device 100 is balanced over the shoulder and does not slide backwards and/or to provide additional comfort to a baby resting on burp device 100.

The neck portion 120 may include a recess 121 (shown with two recesses 121, allowing the burp device 100 to be placed on either shoulder), or inverted side, which may correspond to a concave area (i.e. arcuate recesses) where the neck of the wearer meets the burp device 100 when the burp device 100 is worn for use. The recess 121 may be configured to permit the neck of a wearer to reside in a recessed area of neck portion 120 (i.e. clearance for the neck), which may permit the front portion 110 to rest on the chest of the wearer and the back portion 130 to rest on the back of the wearer, rather than off to the side of a user.

The back portion 130 may include a reservoir 131, which may correspond to a pocket, tank, volume, etc. configured to capture the spit up of a baby when burped. Channels 132 may correspond to raised sections that stand proud of the surface S of back portion 130 and that rise from opposing edges of the back portion 130 and extend to connect to the reservoir to ensure that spit up does not drip, slide, etc., off of the burp device 100 (i.e. off of the sides of back portion 130, such as between neck portion 120 and reservoir 131, etc.) before entering the reservoir 131. Channels 132 also, or alternatively, maintain reservoir 131 in an open position (i.e. limit or prevent the reservoir from closing) as a result of preventing the sides of reservoir 131 (i.e. where channels 132 connect to reservoir) from collapsing and/or providing support that ensures the sides of reservoir are directed away from the base surface S of back portion 130. Channels 132 may extend from an end of the recess 121 proximate the back portion 130, or from the sides of back portion 130, to the reservoir 131. Channels 132 may direct spit up into the reservoir 131. Additionally, or alternatively, guides 133 may correspond to raised portions of the material of back portion 130 that extend from base surface S of the back portion. Guides 133 may provide texture to back portion 130 and may also, or alternatively, direct spit up that is sliding down back portion 130 in this area into reservoir 131. The burp device 100 may be made from a flexible, waterproof material (i.e. silicone, rubber, etc.) so that it contains the spit up in the reservoir 131 without leaking. The burp device 100 may also, or alternatively, be formed from a resilient material (silicone, rubber, etc.) so that the reservoir maintains itself in an open position (as shown in FIGS. 1 and 2) and/or returns to an open position, to ensure that the reservoir is open to catch spit up. The pad 111 may be formed as a part of the remainder of burp device 100, or the pad 111 may be formed from cloth or other soft material to ensure the comfort of the baby.

FIG. 3 depicts a back elevation view of burp device 100. As discussed above, straps 112 of pad 111 may pass through strap penetrations 114 of front portion 110 to connect pad 111 to front portion 110 of burp device 100. Straps 112 may connect on the back side of front portion using hook and loop fasteners of straps 112.

The foregoing description provides illustration and description, but is not intended to be exhaustive or to limit the implementations to the precise form disclosed. Modifications and variations are possible in light of the above disclosure or may be acquired from practice of the embodiments. It should be emphasized that the terms comprises and comprising, when used in this specification, are taken to specify the presence of stated features, integers, steps or components but do not preclude the presence or addition of one or more other features, integers, steps, components or groups thereof.

Even though particular combinations of features are recited in the claims and/or disclosed in the specification, these combinations are not intended to limit the disclosure of the embodiments. In fact, many of these features may be combined in ways not specifically recited in the claims and/or disclosed in the specification.

No element, act, or instruction used in the present application should be construed as critical or essential to the implementations unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A burp device configured to prevent spit up from a baby from contacting a user of the burp device burping the baby, the burp device comprising:

a front portion configured to be placed on the chest of a user;

a neck portion connected to the front portion, the neck portion including a first recess configured to be placed around a portion of the neck of the user;

a back portion connected to the neck portion, the back portion configured to be placed on the back of the user, the back portion comprising a reservoir connected to the back portion opposite the neck portion, the reservoir providing a volume for spit up collection; and a pair of channels connected to opposing edges of the back portion and to the reservoir, the channels configured to direct spit up into the reservoir and to limit or prevent the reservoir from closing.

2. The burp device of claim 1 where the front portion further includes a pad configured to provide a comfortable surface for the baby.

3. The burp device of claim 2 where the pad is removable from the front portion.

4. The burp device of claim 3 where the pad includes straps and the front portion further includes strap penetrations, the straps being placed through the strap penetrations to connect the pad to the front portion.

5. The burp device of claim 1 where the front portion further includes weights configured to prevent the burp device from sliding down the back of the user.

6. The burp device of claim 1 where the neck portion includes a second recess opposite the first recess.

7. The burp device of claim 1 where the back portion further includes guides extending from a base surface of the back portion, the guides configured to direct spit up into the reservoir.

8. The burp device of claim 1, where the front portion, neck portion and back portion are formed from silicone or rubber.

9. The burp device of claim 4 where the straps include hook and loop fasteners.

* * * * *